US008882107B2

(12) United States Patent
Tojo et al.

(10) Patent No.: US 8,882,107 B2
(45) Date of Patent: Nov. 11, 2014

(54) SHEET CONVEYANCE DEVICE, DOCUMENT FEEDER, IMAGE FORMING APPARATUS, AND MULTI FEED DETECTION METHOD

(71) Applicant: KYOCERA Document Solutions Inc., Osaka (JP)

(72) Inventors: Yuki Tojo, Osaka (JP); Masayuki Kakuta, Osaka (JP); Takuro Murata, Osaka (JP); Shinji Akamatsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/052,377

(22) Filed: Oct. 11, 2013

(65) Prior Publication Data

US 2014/0103599 A1 Apr. 17, 2014

(30) Foreign Application Priority Data

Oct. 15, 2012 (JP) ..... 2012-228030

(51) Int. Cl.

| | |
|---|---|
| ***B65H 7/12*** | (2006.01) |
| ***B65H 7/02*** | (2006.01) |
| ***B65H 3/52*** | (2006.01) |
| ***B65H 5/26*** | (2006.01) |
| ***B65H 3/06*** | (2006.01) |
| ***B65H 5/06*** | (2006.01) |

(52) U.S. Cl.

CPC .. *B65H 5/26* (2013.01); *B65H 7/02* (2013.01); *B65H 3/5261* (2013.01); *B65H 2513/512* (2013.01); *B65H 2511/524* (2013.01); *B65H 3/06* (2013.01); *B65H 7/125* (2013.01); *B65H 2701/1311* (2013.01); *B65H 5/062* (2013.01); *B65H 5/06* (2013.01)

USPC ..... 271/262; 271/265.04

(58) Field of Classification Search

USPC ..... 271/121, 125, 262, 265.04

See application file for complete search history.

(56) References Cited

U.S. PATENT DOCUMENTS 7,819,400 B2 * 10/2010 Miyoshii et al. ..... 271/265.04
2007/0096386 A1 * 5/2007 Asada ..... 271/145

FOREIGN PATENT DOCUMENTS

JP 2000-296926 A 10/2000

* cited by examiner

*Primary Examiner* — Michael McCullough
(74) *Attorney, Agent, or Firm* — Studebaker & Brackett PC

(57) ABSTRACT

A sheet conveyance device includes a paper feed section, a separation roller, a registration roller pair arranged downstream of the paper feed section, a conveyance roller pair arranged downstream of the registration roller pair, a multi feed sensor arranged between the paper feed section and the registration roller pair, and a document conveyance controller. When an original document arrives at the conveyance roller pair, the document conveyance controller suspends driving of the paper feed section and starts multi feed determination.

13 Claims, 13 Drawing Sheets

SHEET CONVEYANCE DEVICE, DOCUMENT FEEDER, IMAGE FORMING APPARATUS, AND MULTI FEED DETECTION METHOD

INCORPORATION BY REFERENCE

The present application claims priority under 35 U.S.C. §119 to Japanese Patent Application No. 2012-228030, filed Oct. 15, 2012. The contents of this application are incorporated herein by reference in their entirety.

BACKGROUND

The present disclosure relates to sheet conveyance devices, document feeders, image forming apparatuses, and multi feed determination methods.

Image forming apparatuses including an image reading section to read an original document (sheet) may be provided with a sheet conveyance device to convey an original document to a reading point of the image reading section.

Such a sheet conveyance device includes a document conveyance path continuing from a document table to an exit tray via the reading point. A paper feed roller, a registration roller, and a plurality of conveyance rollers are provided in the document conveyance path in this order from the upstream side (the side of the document table) to the downstream side in the conveyance direction. Upon a start of original document conveyance, the paper feed roller supplies an original document loaded on the document table to the document conveyance path. The registration roller once stops transfer of the original document in the conveyance direction and conveys then the original document in the conveyance direction. The reading point is located downstream of the registration roller. The plurality of conveyance rollers convey the original document having passed over the reading point to the exit tray.

With this configuration, when the paper feed roller supplies an original document from the document table to the document conveyance path, a plurality of original documents may be supplied in an overlap fashion. For this reason, a separation roller to separate the overlapped plurality of original documents on a sheet-by-sheet basis is provided on the opposite side of the document conveyance path to the paper feed roller. In original document conveyance, the paper feed roller is rotated in the conveyance direction, while the separation roller is rotated in the reverse direction to the conveyance direction. Thus, even when a plurality of original documents are supplied in an overlap fashion, an original document not to be conveyed at the moment is returned to the document table.

For example, the separation roller is connected to a torque limiter. When paper feed power exceeds a critical value set in the torque limiter, the separation roller rotates in the forward direction (follows the movement of an original document sent in the conveyance direction to be rotated). While, when a plurality of original documents are supplied in an overlap fashion, an original document not to be conveyed at the moment is present between an original document to be conveyed and the separation roller. This restrains the paper feed power from exceeding the critical value set in the torque limiter. Thus, the separation roller rotating in the reverse rotation returns the original document not to be conveyed at the moment to the document table

SUMMARY

A sheet conveyance device according to the present disclosure includes: a loading section, a paper feed section, a separation section, a first conveyance roller pair, a second conveyance roller pair, a multi feed sensor, and a sheet conveyance controller. A sheet is loaded on the loading section. The paper feed section is configured to allow the sheet loaded on the loading section to transfer to in the conveyance direction supply the sheet to a sheet conveyance path. The separation section is arranged on an opposite side of the sheet conveyance path from the paper feed section and is configured to independently supply the sheet loaded on the loading section to the sheet conveyance path. on a sheet-by-sheet basis. The first conveyance roller pair is arranged downstream of the paper feed section in the conveyance direction and is configured to convey a sheet downstream in the conveyance direction. The second conveyance roller pair is arranged downstream of the first conveyance roller pair in the conveyance direction and is configured to convey the sheet supplied to the sheet conveyance path in the conveyance direction. The multi feed sensor is arranged at a first point between the paper feed section and the first conveyance roller pair and is configured to vary a level of its output signal according to the number of overlapped sheets supplied to the sheet conveyance path. The sheet conveyance controller controls sheet conveyance operation and performs multi feed determination as to whether or not multi feed occurs on the basis of a level of the output signal from the multi feed sensor. When a front end of a sheet arrives at the second conveyance roller pair, the sheet conveyance controller suspends driving of the paper feed section and starts performing the multi feed determination. When occurrence of multi feed is determined, the sheet conveyance controller suspends each driving of the first conveyance roller pair and the second conveyance roller pair.

A multi feed detection method according to the present disclosure includes: drawing out a sheet loaded on a loading section to a sheet conveyance path by driving a paper feed section; independently supplying the sheet drawn out by the paper feed section to the sheet conveyance path on a sheet-by-sheet basis; conveying the sheet supplied to the sheet conveyance path downstream of a first conveyance roller pair by driving the first conveyance roller pair; conveying the sheet conveyed by the first conveyance roller pair downstream of a second conveyance roller pair by driving the second conveyance roller pair; suspending driving of the paper feed section and starting performing multi feed determination as to whether or not multi feed occurs between the paper feed section and the first conveyance roller pair in the sheet conveyance path when a front end of a sheet arrives at the second conveyance roller pair; and suspending each driving of the first conveyance roller pair and the second conveyance roller pair when occurrence of multi feed is determined.

DETAILED DESCRIPTION

An image forming apparatus (multifunction peripheral) capable of executing plural types of jobs, such as a print job, a scan job, etc. will be described as an example in one embodiment of the present disclosure. The image forming apparatus (multifunction peripheral) according to the present embodiment conveys a sheet. The sheet may be formed of paper, cloth, or a film, for example. It is noted that although original documents will be described as one example of sheets herein, the sheets are not limited to the original documents. The sheets may be made of recording paper.

(Overall Configuration of Image Forming Apparatus)

Figure 1:
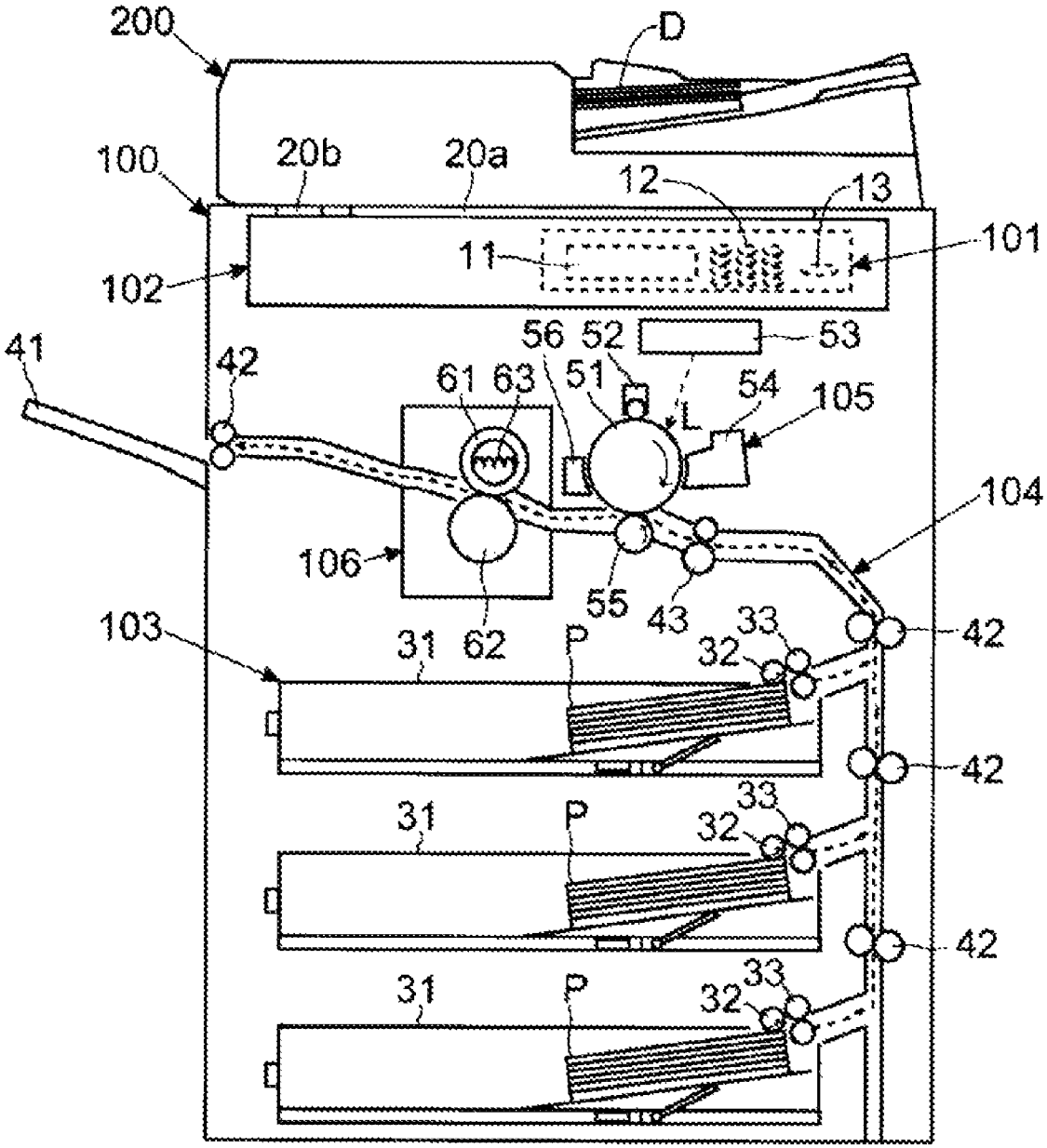
FIG. 1 is a schematic diagram of an image forming apparatus provided with a sheet conveyance device (document feeder) according to one embodiment of the present disclosure.

As shown in FIG. 1, an image forming apparatus 100 according to the present embodiment includes an operation panel 101, an image reading section 102, a paper feed section 103, a paper conveyance section 104, an image forming section 105, and a fusing section 106. A document feeder 200, which corresponds to a sheet conveyance device according to the present disclosure, is arranged on the image forming apparatus 100 (above the image reading section 102). It is noted that the document feeder 200 will be described later in detail.

The operation panel 101 is arranged in the front of the apparatus and includes a liquid crystal display section 11 having a display surface covered with a touch panel. This liquid crystal display section 11 displays a message indicating an apparatus state, soft keys to receive various inputs, etc. Further, the operation panel 101 includes hard keys, such as a numeric keypad 12, a start key 13, etc.

The image reading section 102 reads (scans) one surface of an original document D and generates image data. Though not shown, this image reading section 102 includes optical members, such as an exposure lamp, a mirror, a lens, an image sensor, etc. The image reading section 102 irradiates an original document D, which the user loads on a contact glass 20*a*, with light and A/D converts an output value of the image sensor that receives reflected light from the original document D, thereby generating image data. Alternatively, the image reading section 102 irradiates an original document D, which the document feeder 200 conveys onto a contact glass 20*b*, with light and A/D converts an output value of the image sensor that receives reflected light from the original document D, thereby generating image data. Thus, printing can be performed on the basis of the image data obtained by scanning the original document D by the image reading section 102. Further, the image data obtained by scanning can be accumulated.

The paper feed section 103 includes cassettes 31 to accommodate paper P and supplies the paper P in the cassettes 31 to a paper conveyance path. In order to supply the paper P in each cassette 31 to the paper conveyance path on a sheet-by-sheet basis, the paper feed section 103 includes pickup rollers 32 to draw out the paper P in the corresponding cassettes 31, separation roller pairs 33 to restrain multi feed of the paper P, and so on.

The paper conveyance section 104 conveys the paper P along the paper conveyance path and finally guides it to an exit tray 41. The paper conveyance section 104 includes a plurality of conveyance roller pairs 42 rotatably arranged in the paper conveyance path. Further, the paper conveyance section 104 includes a registration roller pair 43 arranged upstream of the image forming section 105 in a paper conveyance direction (immediately before the image forming apparatus 105). The registration roller pair 43 keeps the paper P waiting immediately before the image forming section 105 and sends out then the paper P to the image forming section 105 with appropriate timing.

The image forming section 105 forms a toner image on the basis of the image data and transfer the toner image to the paper P. The image forming section 105 includes a photosensitive drum 51, an electrostatic charger 52, an exposure device 53, a development device 54, a transfer roller 55, and a cleaning device 56.

For image formation, the photosensitive drum 51 is driven and rotated first. The electrostatic charger 52 electrostatically charges the surface of the photosensitive drum 51 to a predetermined potential. Further, the exposure device 53 outputs a light beam L on the basis of the image data to expose and scan the surface of the photosensitive drum 51. Thus, an electrostatic latent image is formed on the surface of the photosensitive drum 51. The development device 54 supplies toner to the electrostatic latent image formed on the surface of the photosensitive drum 51 for development.

The transfer roller 55 is in press contact with the surface of the photosensitive drum 51 so as to be rotatable. The registration roller pair 43 allows the paper P to transfer between the transfer roller 55 and the photosensitive drum 51 with appropriate timing. At this time, transfer voltage is applied to the transfer roller 55. Thus, the toner image on the surface of the photosensitive drum 51 is transferred to the paper P. Thereafter, the cleaning device 56 removes toner and the like remaining on the surface of the photosensitive drum 51.

The fusing section 106 applies heat and pressure to the toner image transferred to the paper P for fusion. The fusing section 106 includes a heating roller 61 and a pressure roller 62. The heating roller 61 includes a heater 63. The pressure roller 62 is in press contact with the heating roller 61. The paper P to which the toner image is transferred passes between the heating roller 61 and the pressure roller 62 to be heated and pressurized. This fuses the toner image to the paper P. Thus, printing is completed. Thereafter, the conveyance roller pair 42 sends the printed paper P to the exit tray 41.

It is noted that besides the image reading section 102 to read one surface of an original document D, a CIS unit 107 (see FIG. 2) may be provided in the image forming apparatus 100 in order to read the other surface opposite to the one surface of the original document D. In this case, the CIS unit 107 is arranged at, for example, a predetermined position along a document conveyance path 22 of the document feeder 200, which will be described later. Thus, both surfaces of an original document D can be read simultaneously.

(Configuration of Document Feeder)

Figure 2:
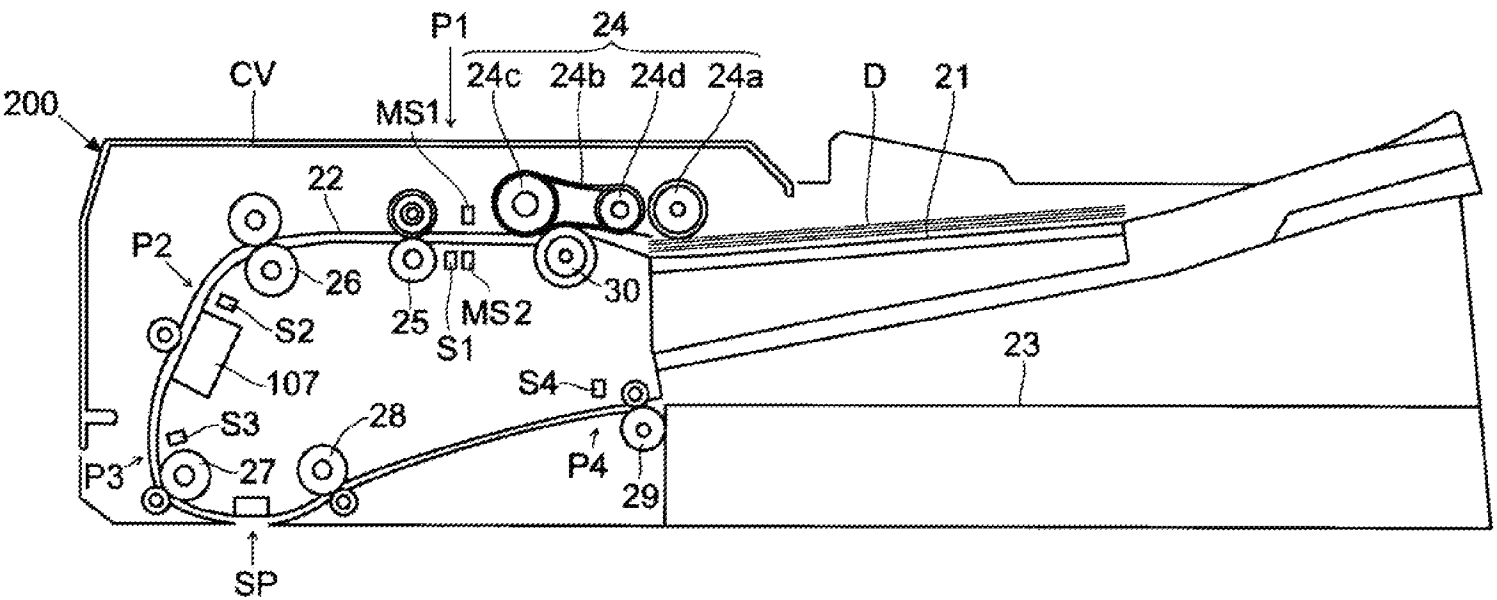
FIG. 2 is a detailed view of the sheet conveyance device provided in the image forming apparatus shown in FIG. 1.

As shown in FIG. 2, the document feeder 200 supplies an original document D loaded on the document setting tray 21 (corresponding to a "loading section" in the present disclosure) to the document conveyance path 22 (corresponding to a "sheet conveyance path" in the present disclosure) and ejects the original document D to a document exit tray 23 through the document conveyance path 22. The position in the middle of the document conveyance path 22 serves as a reading point SP (position facing the contact glass 20*b*). When an original document D is conveyed to the reading point SP, the image reading section 102 reads one of the surfaces of the original document D (the surface facing upward when the document D is set on the document setting tray 21).

There are provided in the document conveyance path 22 a paper feed section 24, a registration roller pair 25 (corresponding to a "first conveyance roller" in the present disclosure), a conveyance roller pair 26 (corresponding to a "second conveyance roller" in the present disclosure), a conveyance roller pair 27, a conveyance roller pair 28, and a paper delivery roller pair 29 in this order from the upstream side in a conveyance direction. That is, the registration roller pair 25 is arranged downstream of the paper feed section 24 in the conveyance direction. The conveyance roller pair 26 is arranged downstream of the registration roller pair 25 in the conveyance direction.

The paper feed section 24 draws out an original document D loaded on the document setting tray 21 and allows it to transfer in the conveyance direction to supply it to the document conveyance path 22. The paper feed section 24 includes a pickup roller 24*a* to draw out an original document D loaded on the document setting tray 21 and a paper feed belt 24*b* to supply the original document D drawn out from the document setting tray 21 by the pickup roller 24*a* to the document conveyance path 22. The paper feed belt 24*b* is wound between a paper feed roller 24*c* as a drive roller and a driven roller 24*d* and is rotated by rotation of the paper feed roller 24*c* (to supply an original document D to the document conveyance path 22).

Further, a separation roller 30 (corresponding to a "separation section" in the present disclosure) is provided on the opposite side of the document conveyance path 22 to the paper feed section 24 (the paper feed belt 24*b*). The separation roller 30 rotates so as to allow an original document D to transfer in the reverse direction to the conveyance direction when the paper feed section 24 supplies the original document D to the document conveyance path 22. Accordingly, when a plurality of original documents D are supplied to the document conveyance path 22 in an overlap fashion, the separation roller 30 separates the overlapped plurality of original documents D on a sheet-by-sheet basis. An original document D not to be conveyed at the moment out of the overlapped plurality of original documents D transfer in the reverse direction to the conveyance direction. It is noted that the paper feed section 24 (the pickup roller 24*a* and the paper feed roller 24*c*) and the separation roller 30 are driven by the same paper feed motor M1 (see FIG. 4).

The registration roller pair 25 once stops transfer in the conveyance direction of an original document D supplied to the document conveyance path 22 and warps the original document D to correct skew of the original document D. The registration roller pair 25 does not rotate at the time when the front end of an original document D arrives there. It starts rotating only after the front end of an original document D arrives there (starts conveyance of the original document D in the conveyance direction). It is noted that the registration roller pair 25 is independently driven by a registration roller motor M2 (see FIG. 4).

The conveyance roller pairs 26-28 convey an original document D supplied to the document conveyance path 22 in the conveyance direction. Further, the paper delivery roller pair 29 ejects an original document D transferring through the document conveyance path 22 to the document exit tray 23. It is noted that the conveyance roller pairs 26-28 and the paper delivery roller pair 29 are driven by the same conveyance motor M3 (see FIG. 4).

Furthermore, document sensors S1, S2, S3, and S4 are provided at a first point P1, a second point P2, a third point P3, and a fourth point P4 in the document conveyance path 22, respectively, to detect the presence of any original document D, to determine timing of conveyance of an original document D, and the like. These document sensors S1-S4 are optical sensors of reflection type including a light emitting section that emits light toward a detection target and a light receiving section that receives reflected light from the detection target, for example. Respective output signals of the document sensors S1-S4 vary between the time when an original document D is present and the time when it is absent at the respective points P1-P4 where the respective sensors S1-S4 are arranged.

It is noted that the first point P1 is located between the paper feed section 24 and the registration roller pair 25. The document sensor S1 arranged at the first point P1 corresponds to a "first sheet sensor" in the present disclosure. The second point P2 is located in the vicinity of the conveyance roller pair 26 (on the downstream side of the registration roller pair 25) between the conveyance roller pair 26 and the conveyance roller pair 27. The document sensor S2 arranged at the second point P2 corresponds to a "second sheet sensor" in the present disclosure. Further, the third point P3 is located in the vicinity of the conveyance roller pair 27 (in the vicinity of the reading point SP) between the conveyance roller pair 26 and the conveyance roller pair 27. The fourth point P4 is located in the vicinity of the paper delivery roller pair 29 (in the vicinity of the document exit tray 23) between the conveyance roller pair 28 and the paper delivery roller pair 29.

Moreover, a multi feed sensor MS for detection of multi feed of original documents D is also provided at the first point P1, at which the document sensor 51 is arranged. Although the multi feed sensor MS and the document sensor 51 are offset in FIG. 2 for easy understanding, they are aligned in a direction orthogonal to the conveyance direction at the first point P1.

For example, the multi feed sensor MS includes a transmission section MS 1 to transmit ultrasonic waves, a receiving section MS2 to receive the ultrasonic waves from the transmission section MS1, and a hold circuit (not shown), such as a capacitor, to store electrical charge that the receiver section MS2 outputs. The output signal of the multi feed sensor MS varies according to the amount of the ultrasonic waves transmitted from the transmission section MS1 to the receiving section MS2. The transmission section MS 1 and the receiving section MS2 of the multi feed sensor MS are opposed to each other with the document conveyance path 22 interposed. Accordingly, when an original document D is sent to the first point P1, the original document D is interposed between the transmission section MS1 and the receiving section MS2 of the multi feed sensor MS. The larger the number of original documents D present at the first point P1, the less the amount of the ultrasonic waves transmitted from the transmission section MS1 to the receiving section MS2. As such, the output signal of the multi feed sensor MS at that time varies according to the presence of any original document D and the number of overlapped original documents D.

Specifically, where a plurality of original documents D are sent to the first point P1 (between the transmission section MS1 and the receiving section MS2 of the multi feed sensor MS) in an overlap fashion, the paper thickness increases in the presence of the plurality of original documents D. Accordingly, the amount of the ultrasonic waves transmitted from the transmission section MS 1 to the receiving section MS2 decreases in comparison with that when only one original document D is sent at the first point P1. Thus, the level of the output signal from the multi feed sensor MS differs between where a plurality of original documents D are sent at the first point P1 in an overlap fashion and where a single original document D is sent at the first point P1.

Furthermore, a size sensor SS (see FIG. 4) to detect the size of an original document D loaded on the document setting tray 21 is provided at the document setting tray 21. The size sensor SS is an optical sensor, for example, and varies its output signal according to the size of an original document D loaded on the document setting tray 21.

Moreover, the document conveyance path 22 is covered with an openable/closable cover CV. The cover CV covers the upper part (part where the paper feed section 24, the registration roller pair 25, the conveyance roller pair 26, etc. are arranged) of the document conveyance path 22. The cover CV is opened for jam clearance, for example. It is noted that the paper feed section 24, the document sensor S1, and the multi feed sensor MS are united and fixed so as not to move from their installed positions. For this reason, even when the cover CV is opened, the paper feed section 24, the document sensor S1, and the multi feed sensor MS remain still at their installed positions. Thus, a shift of the paper feed section 24, the document sensor 51, and the multi feed sensor MS can be reduced.

(Hardware Configurations of Image Forming Apparatus and Document Feeder (Sheet Conveyance Device))

Figure 3:
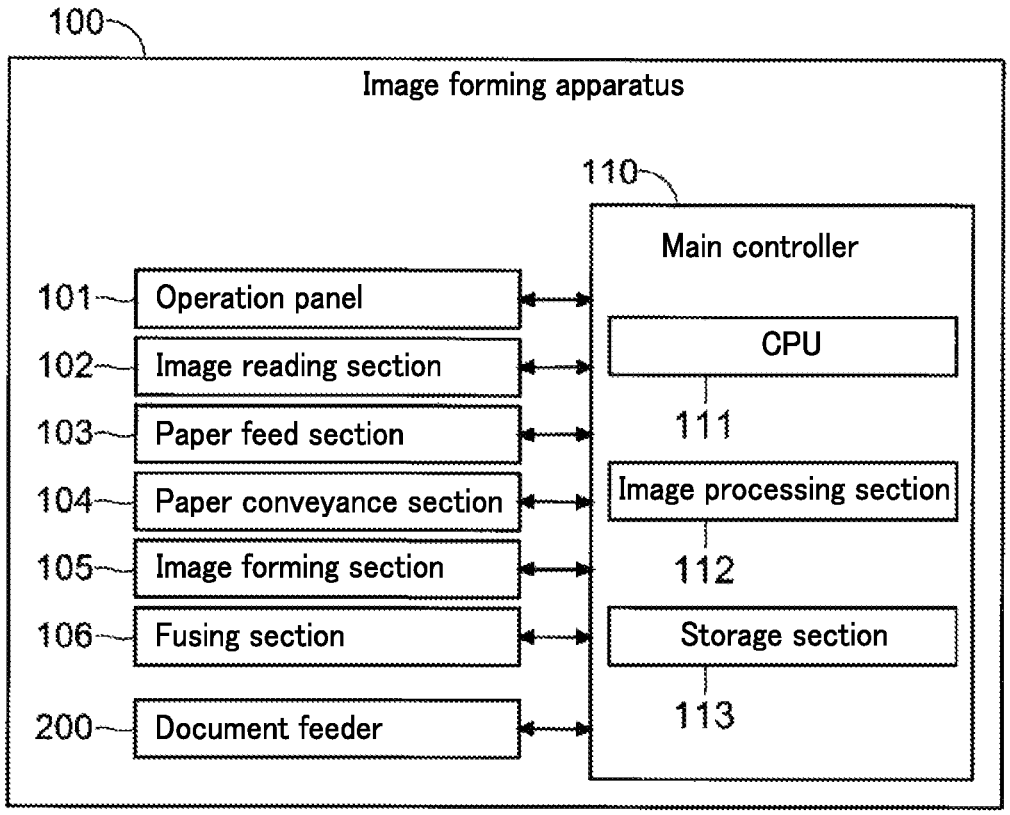
FIG. 3 is a block diagram for explaining a hardware configuration of the image forming apparatus shown in FIG. 1.

As shown in FIG. 3, the image forming apparatus 100 includes a main controller 110 to control the entire apparatus. The main controller 110 includes a CPU 111, an image processing section 112, and a storage section 113. The image processing section 112 includes an ASIC dedicated to image processing, a memory, etc. and performs various types of image processing (zoom, density change, data format conversion, etc.) on image data. The storage section 113 includes a ROM, a RAM, etc. For example, the ROM stores a program and data necessary for job execution. The program and the data are loaded on the RAM.

The operation panel 101, the image reading section 102, the paper feed section 103, the paper conveyance section 104, the image forming section 105, and the fusing section 106 are connected to the main controller 110 to operate on the basis of instructions from the main controller 110. Further, the main controller 110 is connected to the document feeder 200.

Figure 4:
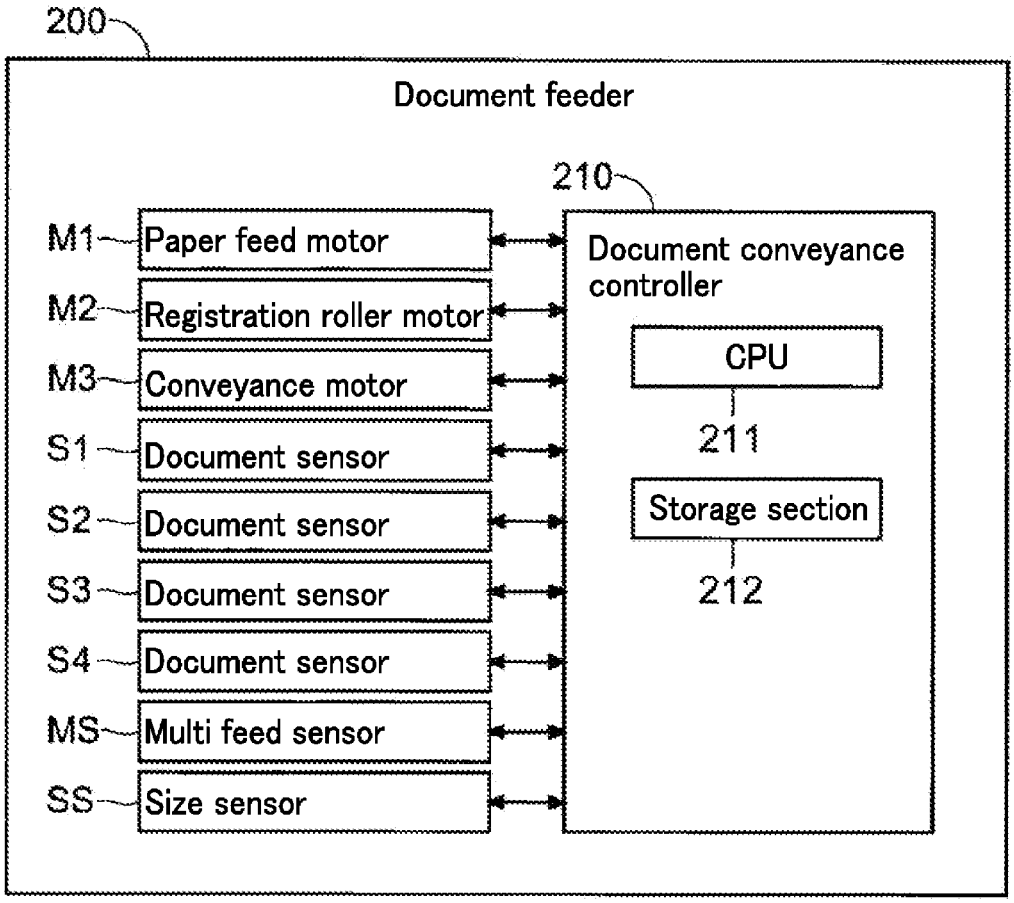
FIG. 4 is a block diagram for explaining a hardware configuration of the sheet conveyance device shown in FIG. 2.

The document feeder 200 includes a document conveyance controller 210 connected to the main controller 110, as shown in FIG. 4. The document conveyance controller 210 includes a CPU 211 and a storage section 212. The document conveyance controller 210 receives an instruction from the main controller 110 to control a document conveyance operation of the document feeder 200. Specifically, the document conveyance controller 210 controls each driving of the paper feed motor M1, the registration roller motor M2, and the conveyance motor M3 to rotate and suspend rotation of the corresponding rollers.

Further, the document conveyance controller (sheet conveyance controller) 210 detects the front and rear ends of an original document D at the first to fourth points P1-P4 on the basis of the respective output signals from the document sensors S1-S4. That is, the document conveyance controller 210 detects arrival and passage of an original document D at and over the first to fourth points P1-P4. The document conveyance controller 210 recognizes arrival and passage of an original document D at and over the first to fourth points P1-P4 to determine the conveyance state of the original document D (whether or not a jam or the like occurs).

Furthermore, the document conveyance controller 210 determines timing of rotation start/suspension of the corresponding rollers on the basis of the output signals from the respective document sensors S1-S4. For example, upon receipt of an instruction to start conveyance of an original document D from the main controller 110, the document conveyance controller 210 allows the paper feed section 24 to start supplying an original document D to the document conveyance path 22 (allows the paper feed motor M1 to drive for rotation of the pickup roller 24*a*, the paper feed roller 24*c*, and the separation roller 30) and detects arrival of the front end of the original document D at the first point P1 on the basis of the output signal of the document sensor S1. Then, the document conveyance controller 210 drives the registration roller motor M2 to rotate the registration roller pair 25. This forms a warp of the original document D, of which front end arrives at the registration roller pair 25, to some extent. After skew of the original document D is corrected, the registration roller pair 25 sends the original document D in the conveyance direction.

Subsequently, when a predetermined time T1 elapses from arrival of the front end of the original document D at the first point P1 (after the front end of the original document D is detected on the basis of the output signal from the document sensor S1), the document conveyance controller 210 drives the conveyance motor M3 to rotate the conveyance roller pairs 26-28 and the paper delivery roller pair 29. Here, the term, the predetermined time T1 means an estimated time period (deemed time period) from arrive at the first point P1 to arrive at the conveyance roller pair 26 taken for the front end of an original document D. Upon lapse of the predetermined time T1 from detection of the front end of an original document D on the basis of the output signal from the document sensor S1, the document conveyance controller 210 determines that the front end of the original document D arrives at the conveyance roller pair 26 (that the conveyance roller pair 26 nips the front end of the original document D). Then, when the predetermined time T1 elapses from detection of the front end of the original document D on the basis of the output signal from the document sensor S1, the document conveyance controller 210 allows the conveyance roller pairs 26-28 and the paper delivery roller pair 29 to start rotating.

Further, at this time point, each driving of the paper feed section 24 (the pickup roller 24*a* and the paper feed roller 24*c*) and the separation roller 30 is suspended so as not to supply a succeeding original document D (an original document D not to be conveyed at the moment) to the document conveyance path 22 together with the preceding original document D (the original document D to be conveyed at the moment). It is noted that the document conveyance controller 210 continues to drive the conveyance roller pairs 26-28 and the paper delivery roller pair 29 until conveyance of all original documents D loaded on the document setting tray 21 is completed. However, upon occurrence of a jam or the like, the document conveyance controller 210 suspends each driving of the conveyance roller pairs 26-28 and the paper delivery roller pair 29 even before conveyance of all the original documents D loaded on the document setting tray 21 is completed.

Further, the document conveyance controller 210 receives the output signal from the multi feed sensor MS. Then, the document conveyance controller 210 performs multi feed determination as to whether or not multi feed occurs on the basis of the output signal from the multi feed sensor MS. The document conveyance controller 210 corresponds to a "document conveyance controller (sheet conveyance controller)" in the present disclosure. For example, a threshold value for multi feed detection is stored in the storage section 212. The document conveyance controller 210 determines whether or not multi feed occurs according to whether the level of the output signal from the multi feed sensor MS exceeds or is below the threshold value for multi feed detection. It is noted that the multi feed determination that the document conveyance controller 210 performs will be described later in detail.

Moreover, the document conveyance controller 210 receives an output signal from the size sensors SS. Then, the document conveyance controller 210 recognizes the size of an original document D loaded on the document setting tray 21 on the basis of the output signal from the size sensor SS.

(Multi Feed Determination)

The multi feed determination performed in the document feeder 200 will be described below. FIGS. 5-13B referred to in the following description schematically show a conveyance path of an original document D.

Figure 5:
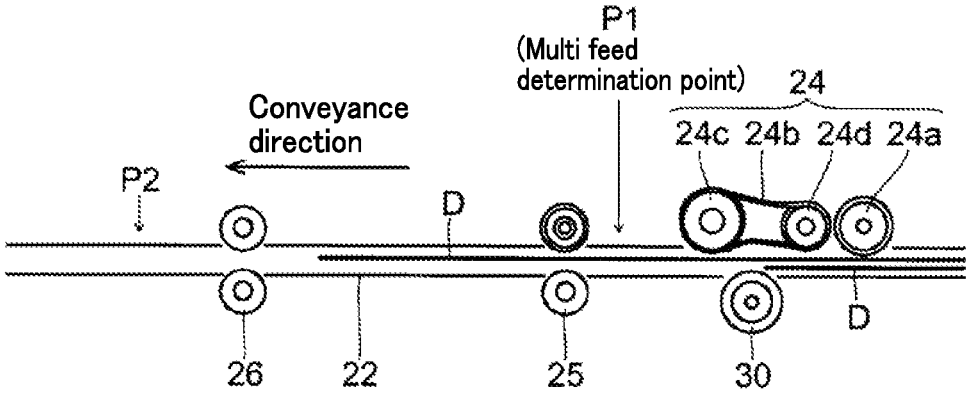
FIG. 5 is a diagram for explaining a conveyance operation performed in the sheet conveyance device shown in FIG. 2.

As shown in FIG. 2, the document feeder 200 includes the separation roller 30 to restrain multi feed of original documents D. Accordingly, as shown in FIG. 5, even when a plurality of original documents D are supplied in an overlap fashion when the paper feed section 24 supplies an original document D to the document conveyance path 22, the plurality of original documents D are separated on a sheet-by-sheet basis so that an original document D not to be conveyed at the moment (an original document D on the downstream side of an original document D to be conveyed at the moment) is restrained from being sent downstream of the separation roller 30 in the conveyance direction.

Figure 6:
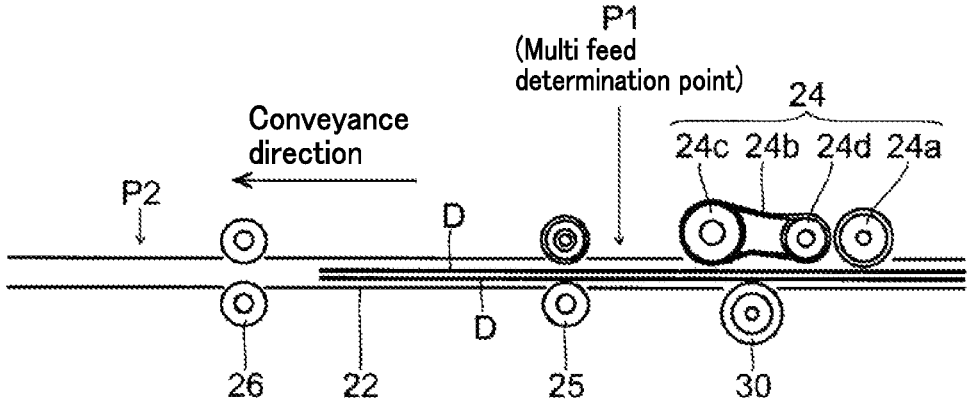
FIG. 6 is a diagram for explaining the conveyance operation performed in the sheet conveyance device shown in FIG. 2.

However, according to circumstances, a plurality of original documents D may be sent downstream of the separation roller 30 in the conveyance direction in an overlap fashion to be nipped by the registration roller pair 25, as shown in FIG. 6. In this case, the plurality of original documents D remaining overlapped are sent to the reading point SP. As a result, an original document D below an original document D to be conveyed at the moment may not be read. It is noted that FIG. 6 shows as one example a state in which a plurality of original documents D are conveyed with each of their front ends in the conveyance direction substantially aligned.

To tackle this problem, the document conveyance controller 210 determines whether or not multi feed occurs (performs multi feed determination) on the basis of the level of the output signal from the multi feed sensor MS arranged at the first point P1 on the downstream side of the separation roller 30 in the conveyance direction (between the paper feed section 24 and the registration roller pair 25). It is noted that the first point P1 is referred to as a multi feed determination point P1 in the following description for the convenience sake. When it is determined that multi feed occurs, the document conveyance controller 210 suspends conveyance of the original documents D (suspends each driving of the registration roller pair 25, the conveyance roller pairs 26-28, and the paper delivery roller pair 29) even if a non-conveyed original document D remains on the document setting tray 21. At this time point, the operation panel 101 displays a message of jam (including multi feed) occurrence, for example.

Figure 7A:
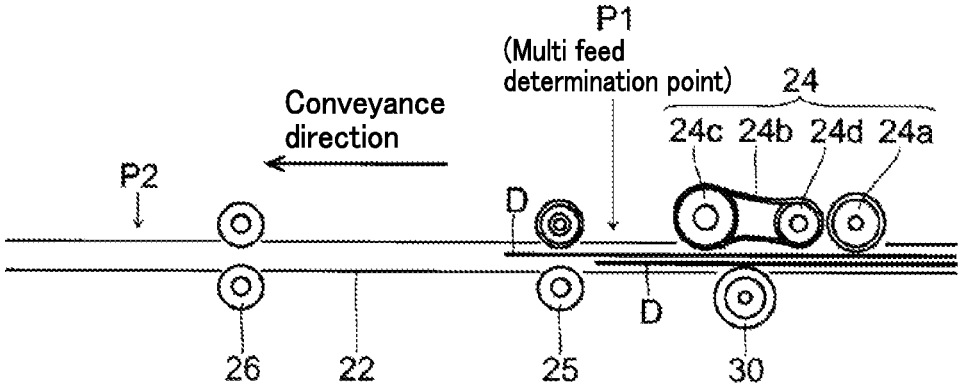
FIG. 7A is a diagram for explaining the conveyance operation performed in the sheet conveyance device shown in FIG. 2.
Figure 7B:
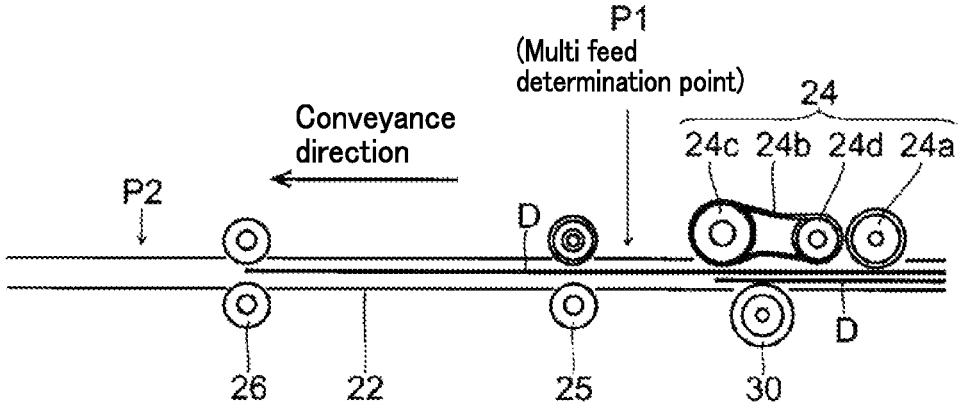
FIG. 7B is a diagram for explaining the conveyance operation performed in the sheet conveyance device shown in FIG. 2.

Here, even when a succeeding original document D (an original document D not to be conveyed at the moment) overlaps with a preceding original document D (an original document D to be conveyed at the moment) and is sent downstream of the separation roller 30 in the conveyance direction (to the multi feed determination point P1), as shown in FIG. 7A, the succeeding original document D may be sent in the reverse direction to the conveyance direction by the separation roller 30, as shown in FIG. 7B, to be returned upstream of the multi feed determination point P1 in the conveyance direction (the front end of the succeeding original document D may not arrive at the registration roller pair 25) in some cases. In this case, if the front end of the preceding original document D arrives at the conveyance roller pair 26, driving of the paper feed section 24 (the pickup roller 24*a* and the paper feed roller 24*c*) is suspended. Accordingly, the front end of the succeeding original document D will not arrive at the registration roller pair 25 (does not transfer in the conveyance direction and stays there until the paper feed section 24 is driven next). Accordingly, even if conveyance of the original document D is continued without suspension, the succeeding original document D will not be conveyed together with the preceding original document D. Thus, multi feed can be eliminated.

However, for example, where the multi feed determination starts from the time point when the front end of an original document D arrives at the multi feed determination point P1 (or the time point when the paper feed section 24 starts supplying an original document D to the document conveyance path 22), conveyance of the original document D is suspended in spite of the fact that a possibility that multi feed is eliminated exists when the original documents D fall in the state shown in FIG. 7A.

To tackle this problem, the document conveyance controller 210 starts multi feed determination when driving of the paper feed section 24 (the pickup roller 24*a* and the paper feed roller 24*c*) is suspended upon arrival of the front end of an original document D at the conveyance roller pair 26, that is, when the predetermined time T1 elapses from arrival of the front end of an original document D at the multi feed determination point P1 (from detection of the front end of the original document D on the basis of the output signal from the document sensor S1). Then, the document conveyance controller 210 performs multi feed determination on the basis of the level of the output signal from the multi feed sensor MS during a predetermined threshold time T2.

Figure 8:
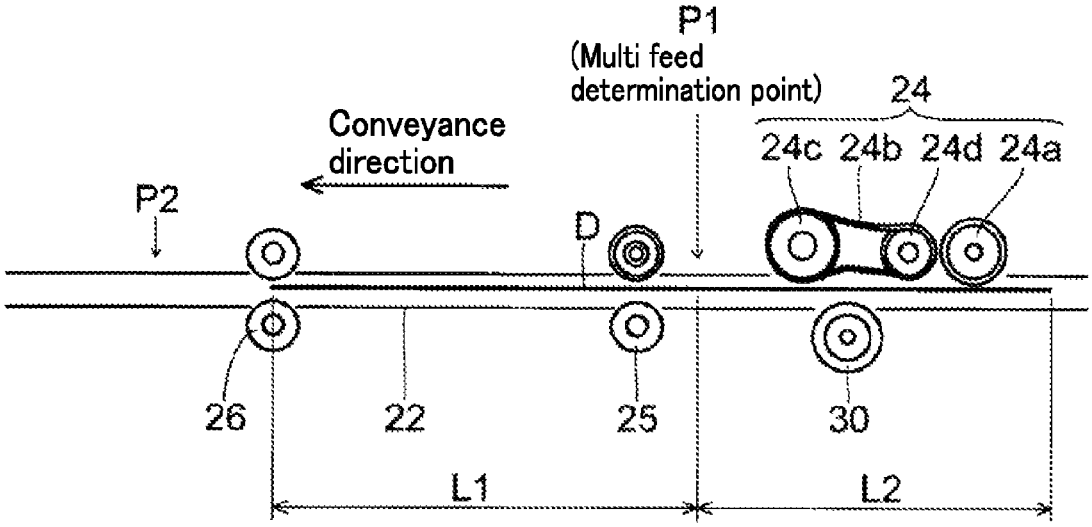
FIG. 8 is a diagram for explaining a method for setting a threshold time used in multi feed determination performed in the sheet conveyance device shown in FIG. 2.

For example, the threshold time T2 is set to be equal to or shorter than a time period taken from arrival of the front end of an original document D at the conveyance roller pair 26 to passage of the rear end thereof over the multi feed determination point P1. Suppose as one example that the total length of an original document D in the conveyance direction is 182 mm, and the distance of the conveyance path from the multi feed determination point P1 to the conveyance roller pair 26 is 100 mm, as shown in FIG. 8. In this case, when the front end of the original document D arrives at the conveyance roller pair 26, the length L1 of part of the original document D on the downstream side from the multi feed determination point P1 is 100 mm, while the length L2 of part thereof remaining on the upstream side from the multi feed determination point P1 is 82 mm. Accordingly, the threshold time T2 in this case is equal to or shorter than a time taken for the part of the original document D with the length L2 of 82 mm, which is remaining on the upstream side from the multi feed determination point P1, to pass over the multi feed determination point P1.

The document conveyance controller 210 sets the threshold time T2. In setting the threshold time T2, the document conveyance controller 210 identifies the size of an original document D loaded on the document setting tray 21 on the basis of the output signal from the size sensor SS and then sets the threshold time T2 according to the length of the original document D in the conveyance direction so that the threshold time T2 is longer as the length of the original document D in the conveyance direction is longer. For example, the document conveyance controller 210 sets as the threshold time T2 a time taken from arrival of the front end of an original document D at the conveyance roller pair 26 to passage of the rear end of the original document D over the multi feed determination point P1. Accordingly, when the threshold time T2 where a B5 size original document D is loaded on the document setting tray 21 is compared with that where an A4 size original document D is loaded thereon, the threshold time T2 where the A4 size original document D is loaded on the document setting tray 21 is longer.

Incidentally, in some cases, all of original documents D loaded on the document setting tray 21 may not be the same in size. Sheets different in size may be loaded on the document setting tray 21. For this reason, the document conveyance controller 210 may set the threshold time T2 according to the length of an original document D with the smallest conveyable size in the conveyance direction. In this case, the threshold time T2 can be set short.

The document conveyance controller 210 performs multi feed determination by determining whether or not the output signal from the multi feed sensor MS is at a level indicating occurrence of multi feed continuously during the threshold time T2 from a start of multi feed determination (after driving of the paper feed section 24 is suspended) in response to arrival of the front end of an original document D at the conveyance roller pair 26. In this manner, the multi feed determination by the document conveyance controller 210 starts at the time point when multi feed is eliminated. Accordingly, where a succeeding original document D is supplied with a preceding original document D in an overlap fashion as shown in FIG. 7A, but the multi feed is eliminated at the time point when the front end of a preceding original document D arrives at the conveyance roller pair 26 (when driving of the paper feed section 24 is suspended), as shown in FIG. 7B, the document conveyance controller 210 determines that no multi feed occurs. That is, in the case shown in FIGS. 7A and 7B, conveyance of the original documents D is continued without suspension.

Figure 9A:
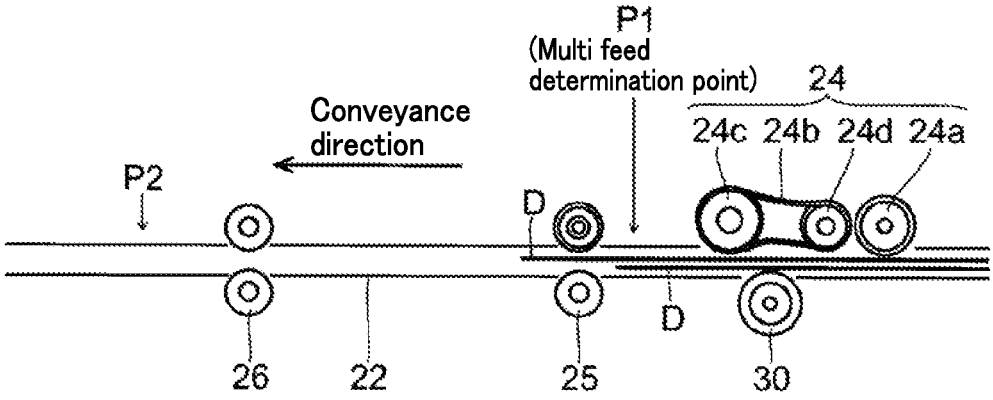
FIG. 9A is a diagram for explaining a conveyance operation (multi feed determination) performed in the sheet conveyance device shown in FIG. 2.

As described above, the document conveyance controller 210 performs multi feed determination by determining whether or not the output signal from the multi feed sensor MS is at a level indicating occurrence of multi feed continuously during the threshold time T2. However, even when it is determined that the output signal from the multi feed sensor MS is at a level indicating occurrence of multi feed continuously during the threshold time T2, the document conveyance controller 210 needs not necessarily determine immediately that multi feed occurs. Because, the original documents D may fall in the state shown in FIG. 9B when the front end of a preceding original document D arrives at the conveyance roller pair 26 (when the document conveyance controller 210 starts multi feed determination) after a succeeding original document D is sent downstream of the separation roller 30 in the conveyance direction with it overlapped with a preceding original document D, as shown in FIG. 9A.

Figure 9B:
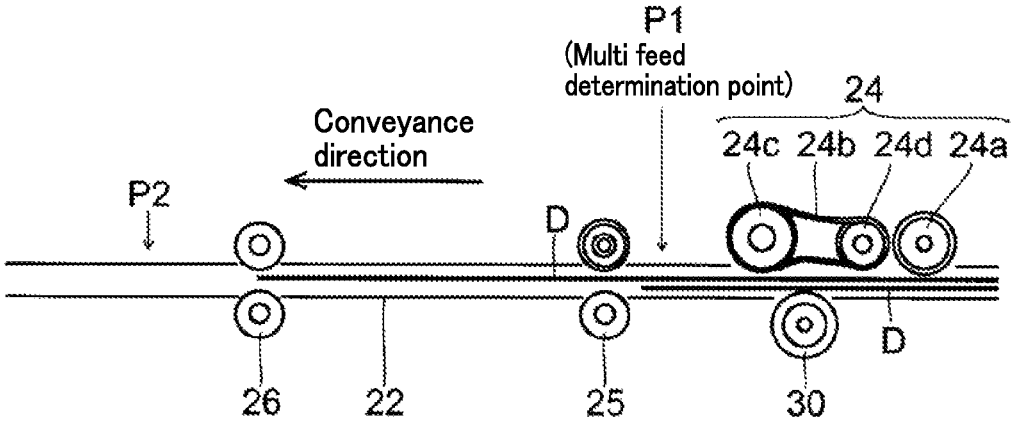
FIG. 9B is a diagram for explaining the conveyance operation (multi feed determination) performed in the sheet conveyance device shown in FIG. 2.

The state shown in FIG. 9B is a state in which a succeeding original document D remains at the multi feed determination point P1 without return in the reverse direction to the conveyance direction, but is not nipped at its front end by the registration roller pair 25. In the case of this state, the succeeding original document D remains at the multi feed determination point P1. Accordingly, the output signal from the multi feed sensor MS is at a level indicating occurrence of multi feed continuously during the threshold time T2 (until the rear end of a preceding original document D passes over the multi feed determination point P1). However, the front end of the succeeding original document D is not nipped by the registration roller pair 25, and driving of the paper feed section 24 (the pickup roller 24*a* and the paper feed roller 24*c*) is suspended. Accordingly, even when the conveyance of the original documents D is continued without suspension, the succeeding original document D will not be conveyed with it overlapped with the preceding original documents D. Continuation of conveyance of the original documents D can eliminate multi feed.

Figure 10A:
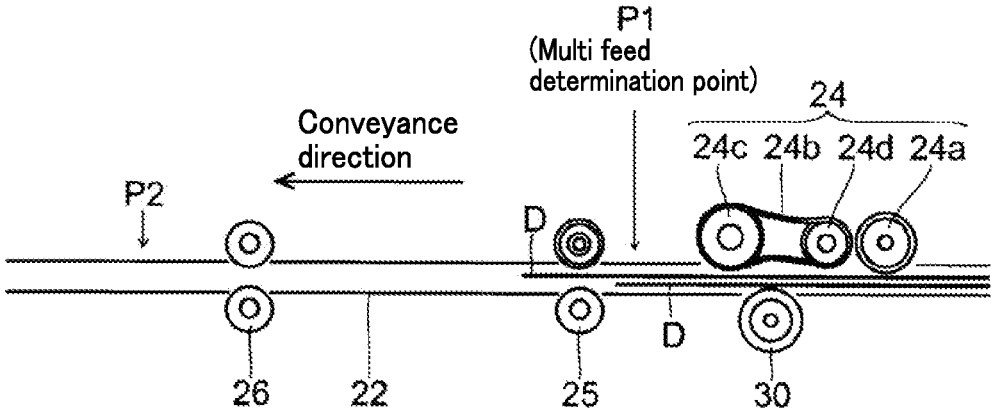
FIG. 10A is a diagram for explaining the conveyance operation (multi feed determination) performed in the sheet conveyance device shown in FIG. 2.
Figure 10B:
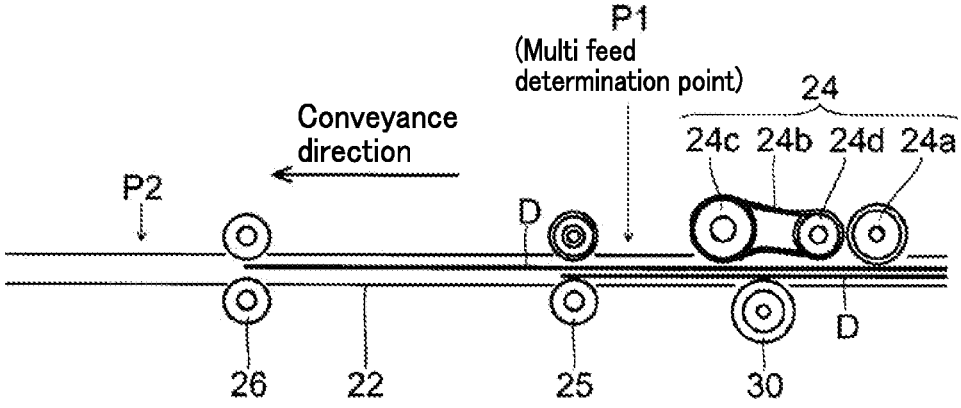
FIG. 10B is a diagram for explaining the conveyance operation (multi feed determination) performed in the sheet conveyance device shown in FIG. 2.

By contrast, as shown in FIGS. 10A and 10B, where a succeeding original document D is supplied with it overlapped with a preceding original document D, the succeeding original document D may be already nipped by the registration roller pair 25 at the time when the front end of the preceding original document D arrives at the conveyance roller pair 26 (when the document conveyance controller 210 starts multi feed determination). In this case, since the succeeding original document D is nipped by the registration roller pair 25, continuation of conveyance of the original documents D without suspension results in conveyance of the succeeding original document D together with the preceding original document D.

To tackle this problem, when the output signal from the multi feed sensor MS is at a level indicating occurrence of multi feed continuously during the threshold time T2 after multi feed determination starts in response to arrival of the front end of the preceding original document D at the conveyance roller pair 26, the document conveyance controller 210 detects, on the basis of the output signal from the document sensor 51 arranged at the multi feed determination point P1, the presence of any original document D at the multi feed determination point P1 in first time TZ1, in which the rear end of the preceding original document D is to pass over the multi feed determination point P1. If the absence of any original document D at the multi feed determination point P1 cannot be detected in the first time TZ1, the original documents D may fall in the state shown in FIG. 9B (multi feed is eliminated) or fall in the state shown in FIG. 10B (multi feed is not eliminated). Accordingly, even if the output signal from the multi feed sensor MS is at a level indicating occurrence of multi feed continuously during the threshold time T2, the document conveyance controller 210 needs not necessarily determine that multi feed occurs at this time point.

Figure 11:
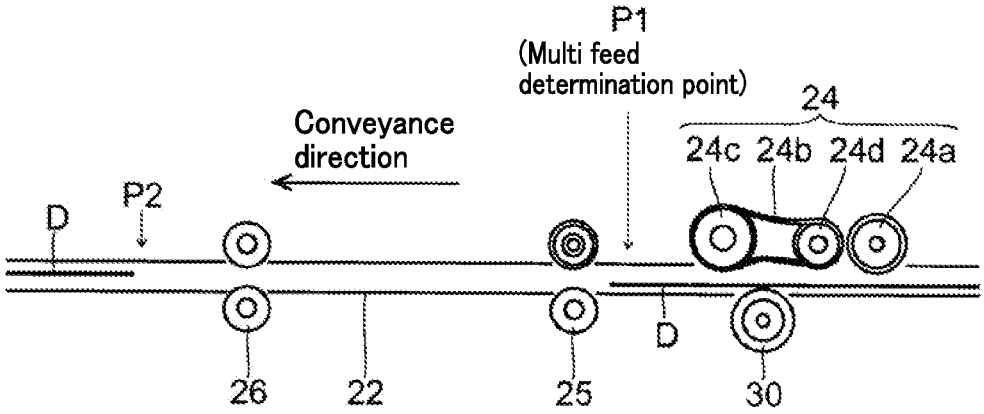
FIG. 11 is a diagram for explaining the conveyance operation (multi feed determination) performed in the sheet conveyance device shown in FIG. 2.
Figure 12:
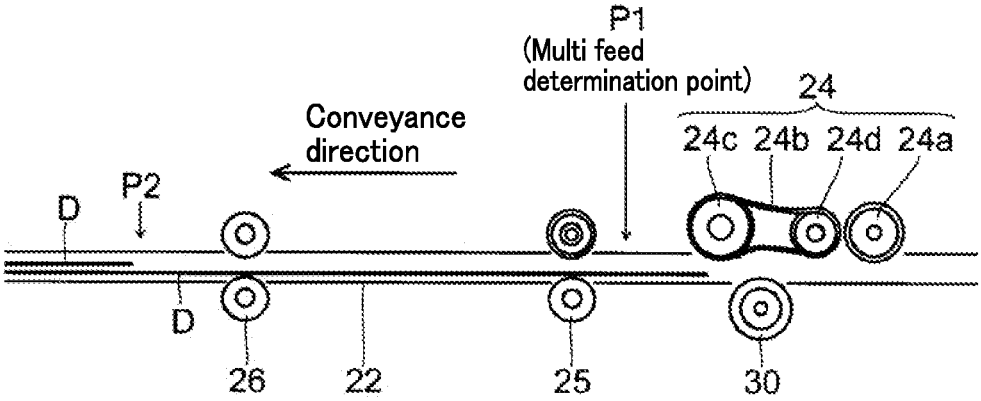
FIG. 12 is a diagram for explaining the conveyance operation (multi feed determination) performed in the sheet conveyance device shown in FIG. 2.

Thereafter, the document conveyance controller 210 detects, on the basis of the output signal from the document sensor S2 arranged at the second point P2, the presence of any original document D at a second point P2 in second time TZ2, in which the rear end of the preceding original document D is to pass over the second point P2. Detection of the absence of any original document D at the second point P2 in the second time TZ2 means no conveyance of a succeeding original document D with it overlapped with the preceding original document D, as shown in FIG. 11 (transition from the state shown in FIG. 9B to the state shown in FIG. 11). Accordingly, the document conveyance controller 210 determines that no multi feed occurs and continues conveyance of the original documents D without suspension. By contrast, no detection of the absence of any original document D at the second point P2 in the second time TZ2 means conveyance of the succeeding original document D with it overlapped with the preceding original document D, as shown in FIG. 12 (transition from the states shown in FIG. 10B to the state shown in FIG. 12). Accordingly, the document conveyance controller 210 determines that multi feed occurs at this time point and suspends conveyance of the original documents D.

Figure 13A:
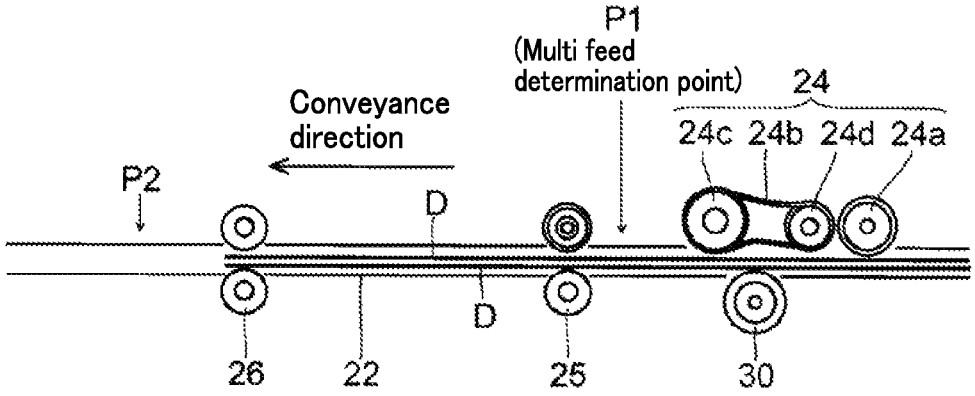
FIG. 13A is a diagram for explaining the conveyance operation (multi feed determination) performed in the sheet conveyance device shown in FIG. 2.
Figure 13B:
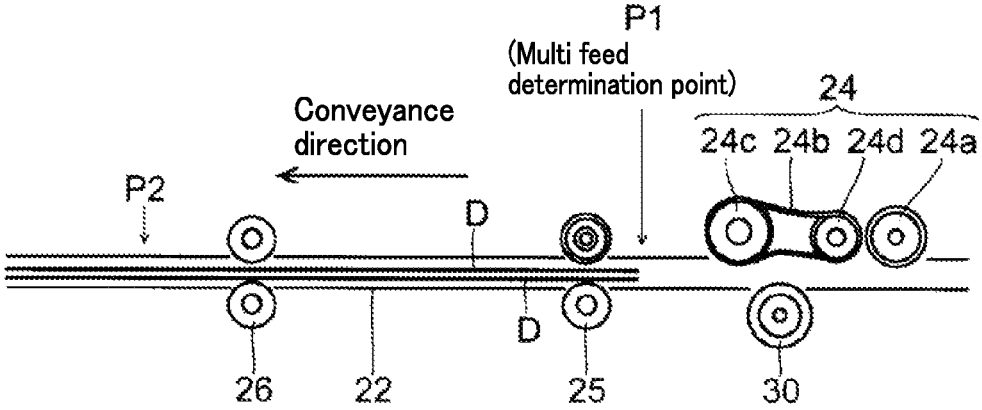
FIG. 13B is a diagram for explaining the conveyance operation (multi feed determination) performed in the sheet conveyance device shown in FIG. 2.

Moreover, as shown in FIG. 6, the front ends (or the rear ends) of a plurality of original documents D in the conveyance direction may be substantially aligned in some cases. In this case, as shown in FIG. 13A, the document conveyance controller 210 performs multi feed determination during the time (threshold time T2) from the time when the front ends of the plurality of original documents D arrive at the conveyance roller pair 26 substantially concurrently to the time when the rear ends of the plurality of original documents D passes over the multi feed determination point P1. In this case, the output signal from the multi feed sensor MS is at a level indicating occurrence of multi feed continuously during the threshold time T2. Thereafter, as shown in FIG. 13B, each rear end of the plurality of original documents D passes over the multi feed determination point P1 substantially concurrently. For this reason, in spite of occurrence of multi feed of the plurality of original documents D, no original document D is present at the multi feed determination point P1 in the first time TZ1. Accordingly, upon detection of the absence of any original document D at the multi feed determination point P1 in the first time TZ1 when the output signal from the multi feed sensor MS is at a level indicating occurrence of multi feed continuously during the threshold time T2, the document conveyance controller 210 determines that multi feed occurs and suspends conveyance of the original documents D.

(Flow of Document Conveyance Operation that the Document Feeder Performs)

Along the flowcharts shown in FIGS. 14 and 15, description will be made below about a flow of the original document conveyance operation that the document feeder 200 performs. It is noted that START of the flowcharts in FIGS. 14 and 15 means time when original documents D are loaded on the document setting tray 21.

At step S1, the document conveyance controller 210 identifies each size of the original documents D loaded on the document setting tray 21 on the basis of the output signal from the size sensor SS, and sets as the threshold time T2 a time taken for an original document D with the identified smallest size from arrival at the conveyance roller pair 26 to passage over the multi feed determination point P1. Then, at step S2, the document conveyance controller 210 determines whether or not an instruction to start conveyance of the original documents D is received from the main controller 110. If the determination results in the presence of the instruction to start conveyance, the routine proceeds to step S3. If the determination results in the absence of the instruction to start conveyance, the determination at step S2 is repeated.

At step S3, the document conveyance controller 210 allows the paper feed section 24 to start supplying the original documents D from the document setting tray 21 to the document conveyance path 22. That is, the document conveyance controller 210 allows the paper feed motor M1 to start driving, thereby rotating the pickup roller 24*a*, the paper feed roller 24*c*, and the separation roller 30.

Then, at step S4, the document conveyance controller 210 determines whether or not the front end of an original document D arrives at the multi feed determination point P1 on the basis of the output signal from the document sensor S1. If the determination results in arrival of the front end of the original document D at the multi feed determination point P1, the routine proceeds to step S5. If the determination results in no arrival of the front end of the original document D at the multi feed determination point P1, the determination at step S4 is repeated.

At step S5, the document conveyance controller 210 allows the registration roller motor M2 to start driving, thereby rotating the registration roller pair 25. Thereafter, at step S6, the document conveyance controller 210 determines whether or not the predetermined time T1 elapses from arrival of the front end of the original document D at the multi feed determination point P1 (from detection of the front end of the original document D on the basis of the output signal from the document sensor S1). That is, the document conveyance controller 210 determines whether or not the front end of the original document D arrives at the conveyance roller pair 26. If the determination results in that the predetermined time T1 elapses, the routine proceeds to step S7. If the determination results in that the predetermined time T1 does not elapse yet, the determination at step S6 is repeated.

At step S7, the document conveyance controller 210 suspends driving of the paper feed motor M1. Further, the document conveyance controller 210 allows the conveyance motor M3 to start (continue) driving. This suspends each rotation of the pickup roller 24*a*, the paper feed roller 24*c*, and the separation roller 30, thereby suspending supply of the original documents D to the document conveyance path 22 by the paper feed section 24. By contrast, the registration roller pair 25, the conveyance roller pairs 26-28, and the paper delivery roller pair 29 remain rotating. This continues conveyance of the original document D on the document conveyance path 22.

Subsequently, at step S8, in response to arrival of the front end of the original document D at conveyance roller pair 26, the document conveyance controller 210 starts multi feed determination at the multi feed determination point P1 on the basis of the level of the output signal from the multi feed sensor MS. Next, at step S9, the document conveyance controller 210 determines whether or not the output signal from the multi feed sensor MS is at a level indicating occurrence of multi feed continuously during the threshold time T2. If the determination results in that the output signal from the multi feed sensor MS is at a level indicating occurrence of multi feed continuously during the threshold time T2, the routine proceeds to step S10.

At step S10, the document conveyance controller 210 determines, on the basis of the output signal from the document sensor S1, whether or not the absence of any original document D at the multi feed determination point P1 is detected in the first time TZ1, in which the rear end of the original document D is to pass over the multi feed determination point P1. If the detection results in that the absence of any original document D at the multi feed determination point P1 is in the first time TZ1, the routine proceeds to step S11. If the absence of any original document D at the multi feed determination point P1 is not detected in the first time TZ1 (the presence of any original document D is detected), the routine proceeds to step S12.

When the routine proceeds from step S10 to step S11, the document conveyance controller 210 suspends conveyance of the original documents D. That is, the document conveyance controller 210 determines that multi feed occurs (determines that the original documents D fall in the state shown in FIG. 13B).

When the routine proceeds from step S10 to step S12, the document conveyance controller 210 determines, on the basis of the output signal from the document sensor S2, whether or not the absence of any original document D at the second point P2 is detected in the second time TZ2, in which the rear end of the original document D is to pass over the second point P2. If the detection results in that the absence of any original document D at the second point P2 is not in the second time TZ2 (the presence of any original document D is detected), the routine proceeds to step S11. At step S11, the document conveyance controller 210 suspends conveyance of the original document D. That is, the document conveyance controller 210 determines that multi feed occurs (determines that the original documents D fall into the state shown in FIG. 12 from the state shown in FIG. 10B).

By contrast, if the absence of any original document D at the second point P2 is detected in the second time TZ2 at step S12, the routine proceeds to step S13. Then, at step S13, the document conveyance controller 210 allows the paper feed section 24 to continue conveying the original documents D without suspension. That is, the document conveyance controller 210 determines that no multi feed occurs (determines that the original documents D shown in FIG. 9B fall into the state shown in FIG. 11). Further, even when the output signal from the multi feed sensor MS is not at a level indicating occurrence of multi feed continuously during the threshold time T2 at step S9, the routine proceeds to step S13. After the routine proceeds to step S13 for continuation of conveyance of the original documents D without suspension, the routine proceeds to step S14.

At step S14, the document conveyance controller 210 determines whether or not any original document D not yet conveyed remains on the document setting tray 21. If the determination results in that any original document D not conveyed yet remains there, the routine proceeds to step S3. If no original document D not yet conveyed remains there, the original document conveyance operation is terminated.

Figure 14:
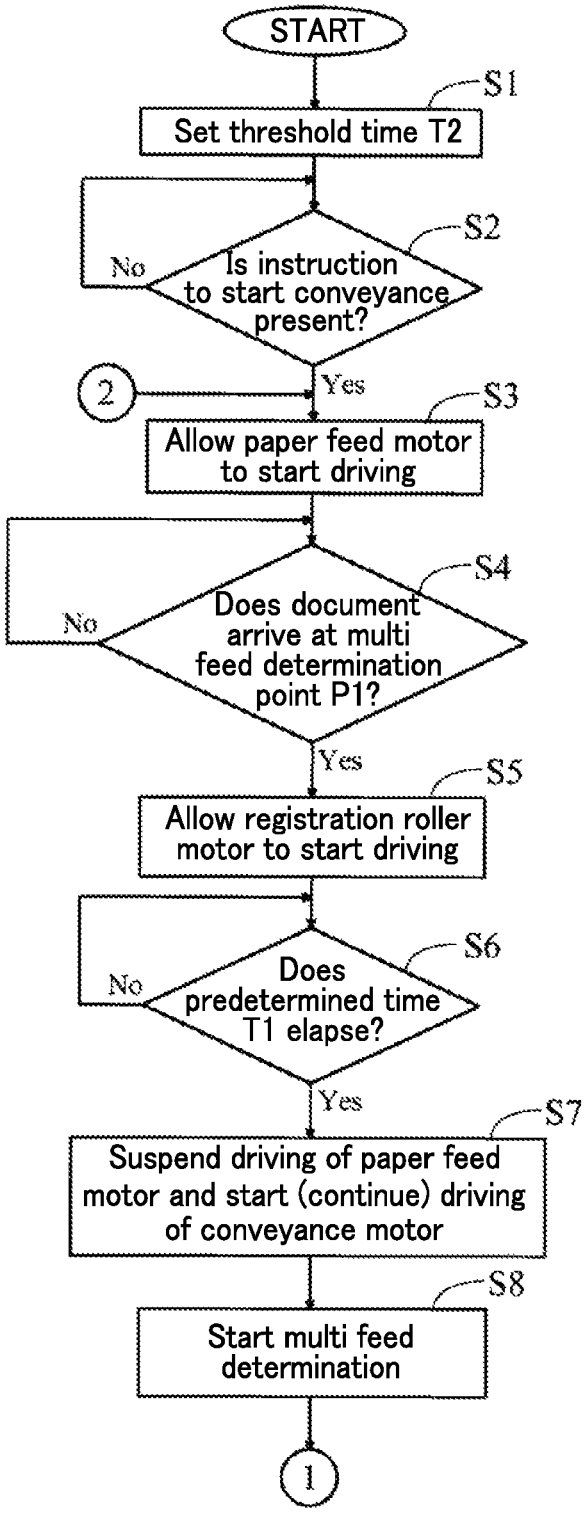
FIG. 14 is a flowchart for explaining a flow of the conveyance operation (multi feed determination) performed in the sheet conveyance device shown in FIG. 2.
Figure 15:
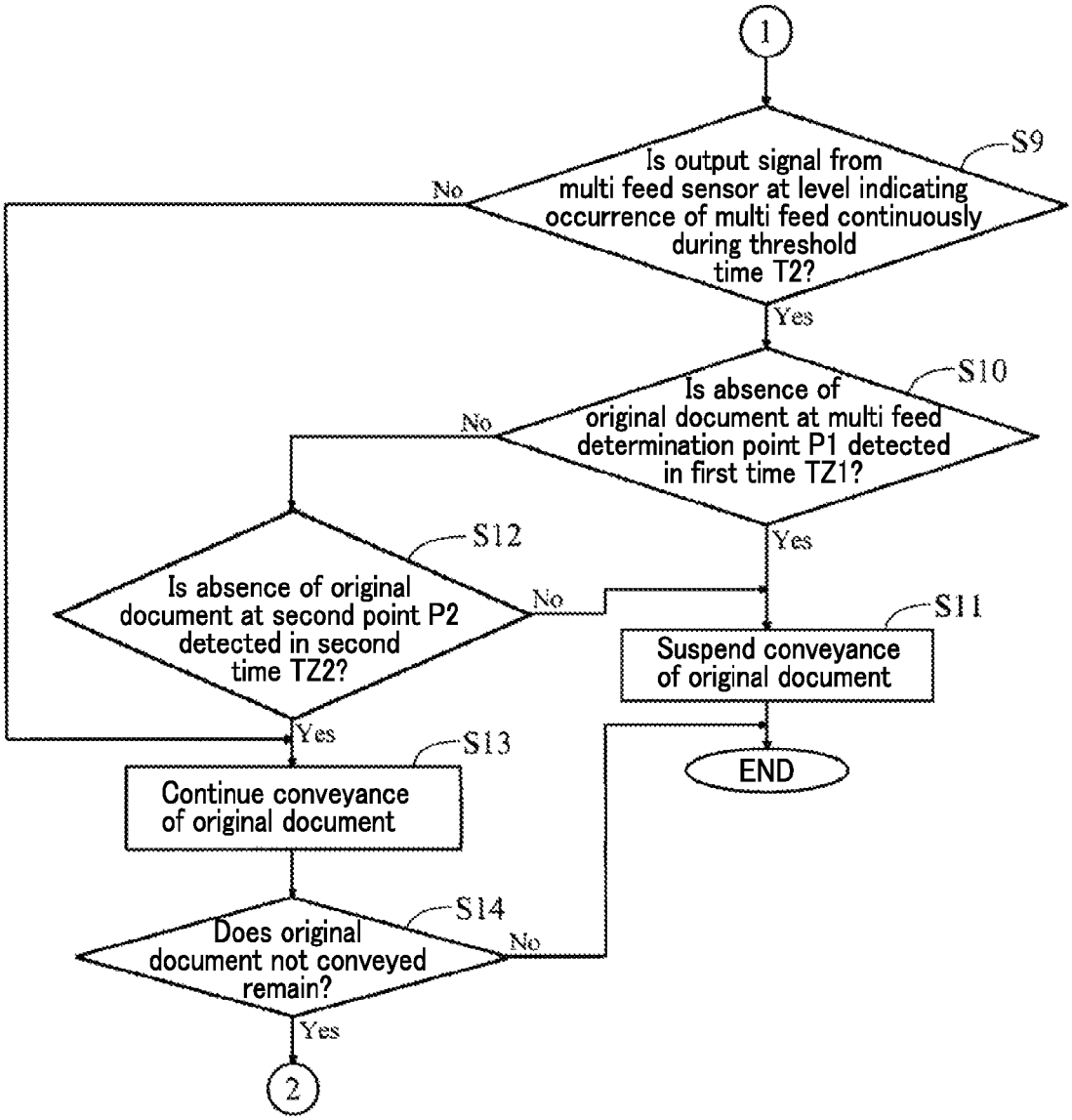
FIG. 15 is a flowchart for explaining the flow of the conveyance operation (multi feed determination) performed in the sheet conveyance device shown in FIG. 2.

It is noted that steps S10 and S12 may be omitted in the flowcharts of FIGS. 14 and 15. That is, if the output signal from the multi feed sensor MS is at a level indicating occurrence of multi feed continuously during the threshold time T2 at step S9, the routine can proceed to step S11 for suspension of conveyance of the original documents D. If the output signal from the multi feed sensor MS is not at a level indicating occurrence of multi feed continuously during the threshold time T2, the routine may proceed to step S13 for continuation of conveyance of the original documents D.

The document feeder 200 (sheet conveyance device) according to the present embodiment includes the document setting tray 21 (loading section), the paper feed section 24, the separation roller 30 (separation section), the registration roller pair 25 (first conveyance roller pair), the conveyance roller pair 26 (second conveyance roller pair), the multi feed sensor MS, and the document conveyance controller 210 (sheet conveyance controller). Original documents D (sheets) are loaded on the document setting tray 21 (loading section). The paper feed section 24 allows the original documents D loaded on the document setting tray 21 to transfer in the conveyance direction to supply the original documents D to the document conveyance path 22 (sheet conveyance path). The separation roller 30 (separation section) is arranged on the opposite side of the document conveyance path 22 from the paper feed section 24 and is used for separating a stack of original documents D (sheet stack) loaded on the document setting tray 21 and supplying them on a sheet-by-sheet basis to the document conveyance path 22. The registration roller pair 25 (first conveyance roller pair) is arranged downstream of the paper feed section 24 in the conveyance direction and conveys each original document D downstream. The conveyance roller pair 26 (second conveyance roller pair) is arranged downstream of the registration roller pair 25 in the conveyance direction and conveys each original document D supplied to the document conveyance path 22 in the conveyance direction. The multi feed sensor MS is arranged at the multi feed determination point P1 (first point) between the paper feed section 24 and the registration roller pair 25 and varies the level of its output signal according to the number of overlapped original documents D supplied to the document conveyance path 22. The document conveyance controller 210 (sheet conveyance controller) performs multi feed determination as to whether or not multi feed occurs on the basis of the level of the output signal from the multi feed sensor MS. When the front end of an original document D arrives at the conveyance roller pair 26, the document conveyance controller 210 is set so as to suspend driving of the paper feed section 24 and start multi feed determination. Upon determination of occurrence of multi feed by the document conveyance controller 210, each driving of the registration roller pair 25, the conveyance roller pairs 26-28, and the paper delivery roller pair 29 is suspended.

In the present embodiment, even if a plurality of original documents D are supplied in an overlap fashion in supplying an original document D to the document conveyance path 22 by the paper feed section 24, the separation roller 30 may make an original document D not to be conveyed at the moment to remain on the upstream side of the multi feed determination point P1 in the conveyance direction. In view of this, driving of the paper feed section 24 is set so as to be suspended when the front end of an original document D arrives at the conveyance roller pair 26. Accordingly, if an original document D not to be conveyed at the moment stays on the upstream side of the multi feed determination point P1 in the conveyance direction when the front end of an original document D arrives at the conveyance roller pair 26 (when driving of the paper feed section 24 is suspended), an original document D to be conveyed at the moment is sent in the conveyance direction by the registration roller pair 25 and the conveyance roller pair 26. While on the other hand, the original document D not to be sent at the moment stays on the upstream side of the multi feed determination point P1 in the conveyance direction. Thus, the multi feed can be eliminated. Further, the document conveyance controller 210 is set so as to start performing multi feed determination based on the level of the output signal from the multi feed sensor MS upon arrival of the front end of an original document D at the conveyance roller pair 26 (when driving of the paper feed section 24 is suspended). Thus, even when multi feed occurs in supplying original documents D to the document conveyance path 22 by the paper feed section 24, if the multi feed is eliminated (if the original document D not to be conveyed at the moment stays on the upstream side of the multi feed determination point P1 in the conveyance direction), the document conveyance controller 210 determines that no multi feed occurs. This allows continuation of conveyance of the original documents D without suspension of each driving of the registration roller pair 25, the conveyance roller pairs 26-28, and the paper delivery roller pair 29. Thus, even upon occurrence of multi feed, when the multi feed is eliminated, the original document conveyance operation can be continued without suspension.

Further, in the present embodiment, as described above, the document conveyance controller 210 performs multi feed determination by determining whether or not the output signal of the multi feed sensor MS is at a level indicating occurrence of multi feed continuously during the threshold time T2, which is set to be equal to or shorter than a time taken from arrival of the front end of an original document D at the conveyance roller pair 26 to passage of the rear end of the original document D over the multi feed determination point P1. This can achieve accurate multi feed determination based on the level of the output signal from the multi feed sensor MS.

Yet further, as described above, the document sensor 51 (first sheet sensor) and the document sensor S2 (second sheet sensor) are provided in the present embodiment. The document sensor 51 (first sheet sensor) is arranged at the multi feed determination point P1 and is used for detecting the presence of any original document D at the multi feed determination point P1. The document sensor S2 (second sheet sensor) is arranged at the second point P2 on the downstream side of the registration roller pair 25 in the conveyance direction and is used for detecting the presence of any original document D at the second point P2. In this case, the document conveyance controller 210 detects the presence of any original document D at the multi feed determination point P1 on the basis of the output signal from the document sensor 51, while detecting the presence of any original document D at the second point P2 on the basis of the output signal from the document sensor S2. Upon no detection of the absence of any original document D (detection of the presence of any original document D) at the multi feed determination point P1 in the first time TZ1, in which the rear end of an original document D is to pass over the multi feed determination point P1, and detection of the absence of any original document D at the second point P2 in the second time TZ2, in which the rear end of the original document D is to pass over the second point P2 when the output signal of the multi feed sensor MS is at a level indicating occurrence of multi feed continuously during the threshold time T2 from a start of multi feed determination in response to arrival of the front end of an original document D at the conveyance roller pair 26, the document conveyance controller 210 determines that no multi feed occurs.

By contrast, upon no detection of the absence of any original document D at the multi feed determination point P1 in the first time TZ1 (detection of the presence of any original document D) and no detection of the absence of any original document D at the second point P2 in the second time TZ2 (detection of the presence of any original document D) when the output signal of the multi feed sensor MS is at a level indicating occurrence of multi feed continuously during the threshold time T2 from a start of multi feed determination in response to arrival of the front end of an original document D at the conveyance roller pair 26, the document conveyance controller 210 determines that multi feed occurs.

Still further, upon detection of the absence of any original document D at the multi feed determination point P1 in the first time TZ1 when the output signal of the multi feed sensor MS is at a level indicating occurrence of multi feed continuously during the threshold time T2 from a start of multi feed determination in response to arrival of the front end of an original document D at the conveyance roller pair 26, the document conveyance controller 210 determines that multi feed occurs.

Thus, multi feed determination using not only the multi feed sensor MS but also the document sensors 51 and S2 can achieve further accurate recognition as to whether or not multi feed is eliminated. That is, when the front end of an original document D to be conveyed at the moment arrives at the conveyance roller pair 26, it is determined that no multi feed occurs (multi feed is eliminated) if an original document D not to be conveyed at the moment remains at the multi feed determination point P1 without return in the reverse direction to the conveyance direction unless the front end of a succeeding original document D is nipped by the registration roller pair 25, as shown in FIG. 9B. Further, when the front end of an original document D to be conveyed at the moment arrives at the conveyance roller pair 26, it is determined that multi feed occurs (multi feed is not eliminated) if an original document D not to be conveyed at the moment is already nipped by the registration roller pair 25, as shown in FIG. 10B. Furthermore, in the case where the front ends (rear ends) of a plurality of original documents D in the conveyance direction are substantially aligned, as shown in FIGS. 13A and 13B, it is determined that multi feed occurs (multi feed is not eliminate).

It is noted as a modified example that it may be determined that multi feed occurs when the output signal from the multi feed sensor MS is at a level indicating occurrence of multi feed continuously during the threshold time T2 from a start of multi feed determination in response to arrival of the front end of an original document D at the conveyance roller pair 26.

Moreover, as described above, the size sensor SS are further provided in the present embodiment to detect the size of an original document D loaded on the document setting tray 21 (loading section). The document conveyance controller 210 recognizes the length of an original document D loaded on the document setting tray 21 in the conveyance direction on the basis of the output signal from the size sensor SS and sets the threshold time T2 according to the length of the original document D loaded on the document setting tray 21 in the conveyance direction. When the front end of an original document D arrives at the conveyance roller pair 26, the longer the total length of the original document D in the conveyance direction, the longer the part of the original document D remaining on the upstream side from the multi feed determination point P1. Accordingly, the threshold time T2 is set longer as an original document D loaded on the document setting tray 21 in the conveyance direction is longer. This setting can achieve accurate multi feed determination.

However, in the case where original documents D different in size are loaded on the document setting tray 21, it is preferable to set the threshold time T2 according to the length of an original document D with the smallest conveyable size in the conveyance direction.

All of the embodiments disclosed herein are mere examples and should not be taken as limitations. The scope of the present disclosure is defined by the appended claims, rather than the above embodiments, and includes any equivalents to the scope of the claims and any alterations and modification within the scope.

For example, although the separation roller is employed as the separation section in the above embodiment, the present disclosure is not limited to this and can employ a friction plate or the like as the separation section.

What is claimed is:

1. A sheet conveyance device comprising:

a loading section on which a sheet is loaded;

a paper feed section configured to allow the sheet loaded on the loading section to transfer in a conveyance direction to supply the sheet to a sheet conveyance path;

a separation section arranged on an opposite side of the sheet conveyance path from the paper feed section and configured to independently supply the sheet loaded on the loading section to the sheet conveyance path on a sheet-by-sheet basis;

a first conveyance roller pair arranged downstream of the paper feed section in the conveyance direction and configured to convey a sheet downstream in the conveyance direction;

a second conveyance roller pair arranged downstream of the first conveyance roller pair in the conveyance direction and configured to convey the sheet supplied to the sheet conveyance path in the conveyance direction;

a first sheet sensor arranged at a first point between the paper feed section and the first conveyance roller pair and configured to detect presence of any sheet at the first point;

a multi feed sensor arranged between the paper feed section and the first conveyance roller pair and configured to vary a level of its output signal according to the number of overlapped sheets supplied to the sheet conveyance path; and a sheet conveyance controller configured to control sheet conveyance operation by the paper feed section, the separation section, the first conveyance roller pair, and the second conveyance roller pair and perform multi feed determination as to whether or not multi feed occurs on the basis of a level of the output signal from the multi feed sensor, wherein when a front end of a sheet that the first sheet sensor has detected at the first point arrives at the second conveyance roller pair, the sheet conveyance controller suspends driving of the paper feed section and starts performing the multi feed determination, the first conveyance roller pair and the second conveyance roller pair driving during the multi feed determination, and when occurrence of multi feed is determined, the sheet conveyance controller suspends each driving of the first conveyance roller pair and the second conveyance roller pair.

2. A device according to claim 1, wherein the sheet conveyance controller performs the multi feed determination by determining whether or not the output signal from the multi feed sensor is at a level indicating occurrence of multi feed continuously during a threshold time, which is set equal to or shorter than a time taken from arrival of a front end of a sheet at the second conveyance roller pair to passage of a rear end of the sheet over the first point, and the sheet conveyance controller determines that multi feed occurs when the output signal of the multi feed sensor is at a level indicating occurrence of multi feed continuously during the threshold time.

3. A device according to claim 2, further comprising:

a second sheet sensor arranged at a second point on a downstream side of the first conveyance roller pair in the conveyance direction and configured to detect presence of any sheet at the second point, wherein the sheet conveyance controller detects presence of any sheet at the first point on the basis of an output signal from the first sheet sensor and detects presence of any sheet at the second point on the basis of an output signal from the second sheet sensor, and when the output signal of the multi feed sensor is at a level indicating occurrence of multi feed continuously during the threshold time from a start of the multi feed determination in response to arrival of a front end of a sheet at the second conveyance roller pair, the sheet conveyance controller determines that no multi feed occurs if the presence of any sheet at the first point is detected in first time, in which a rear end of a sheet is to pass over the first point, and no sheet at the second point is detected in second time, in which the rear end of the sheet is to pass over the second point.

4. A device according to claim 3, wherein when the output signal of the multi feed sensor is at a level indicating occurrence of multi feed continuously during the threshold time from a start of the multi feed determination in response to arrival of a front end of a sheet at the second conveyance roller pair, the sheet conveyance controller determines that multi feed occurs if the presence of any sheet at the first point is detected in the first time, and the presence of any sheet at the second point is detected in the second time.

5. A device according to claim 3, wherein when the output signal of the multi feed sensor is at a level indicating occurrence of multi feed continuously during the threshold time from a start of the multi feed determination in response to arrival of a front end of a sheet at the second conveyance roller pair, the sheet conveyance controller determines that multi feed occurs if no sheet at the first point is detected in the first time.

6. A device according to claim 2, further comprising:

a size sensor configured to detect size of the sheet loaded on the loading section, wherein the sheet conveyance controller recognizes a length of the sheet loaded on the loading section in the conveyance direction on the basis of an output signal from the size sensor and sets the threshold time according to the length of the sheet loaded on the loading section in the conveyance direction.

7. A device according to claim 6, wherein the sheet conveyance controller sets the threshold time longer as the length of the sheet loaded on the loading section in the conveyance direction is longer.

8. A device according to claim 6, wherein where sheets different in size are loaded on the loading section, the sheet conveyance controller sets the threshold time according to a length of a sheet with a smallest conveyable size in the conveyance direction.

9. A device according to claim 1, wherein the separation section includes a separation roller configured to rotate so as to allow a sheet not to be conveyed at the moment out of a plurality of sheets supplied to the sheet conveyance path in an overlap fashion to transfer in a reverse direction to the conveyance direction.

10. A device according to claim 1, wherein the first conveyance roller pair once stops transfer of the sheets supplied to the sheet conveyance path in the conveyance direction and then starts conveyance of the sheets in the conveyance direction.

11. A document feeder, which conveys an original document with the use of the sheet conveyance device according to claim 1.

12. An image forming apparatus, comprising the sheet conveyance device according to claim 1.

13. A multi feed detection method comprising:

drawing out a sheet loaded on a loading section to a sheet conveyance path by driving a paper feed section;

independently supplying the sheet drawn out by the paper feed section to the sheet conveyance path on a sheet-by-sheet basis;

conveying the sheet supplied to the sheet conveyance path downstream of a first conveyance roller pair by driving the first conveyance roller pair;

conveying the sheet conveyed by the first conveyance roller pair downstream of a second conveyance roller pair by driving the second conveyance roller pair;

suspending driving of the paper feed section and starting performing multi feed determination by a sheet conveyance controller based on an output signal from a multi feed sensor as to whether or not multi feed occurs between the paper feed section and the first conveyance roller pair in the sheet conveyance path when a front end of a sheet arrives at the second conveyance roller pair, the first conveyance roller pair and the second conveyance roller pair driving during the multi feed determination; and suspending by the sheet conveyance controller each driving of the first conveyance roller pair and the second conveyance roller pair when occurrence of multi feed is determined.

* * * * *